United States Patent [19]

Bermudez

[11] 4,073,478

[45] Feb. 14, 1978

[54] FENCE STRUCTURE

[76] Inventor: Eduardo Bermudez, 610 Solano Prado, Coral Gables, Fla. 33156

[21] Appl. No.: 772,687

[22] Filed: Feb. 28, 1977

[51] Int. Cl.[2] ..... E04H 17/14

[52] U.S. Cl. ..... 256/27; 256/65

[58] Field of Search ..... 256/24, 25, 21, 22, 256/65, 73, 27

[56] References Cited

U.S. PATENT DOCUMENTS

| | | | |
|---|---|---|---|
| 124,502 | 3/1872 | McKnight | 256/24 |
| 1,764,584 | 6/1930 | Tarrier | 256/25 X |
| 2,484,413 | 10/1949 | Kouril, Jr. | 256/73 X |
| 2,751,248 | 6/1956 | Krister | 296/43 |
| 2,780,440 | 2/1957 | Krieger | 256/65 X |
| 3,614,068 | 10/1971 | Koehl | 256/24 |
| 3,815,877 | 6/1974 | Turner | 256/24 |
| 3,910,560 | 10/1975 | Goetz | 256/24 |

*Primary Examiner*—Andrew V. Kundrat

[57] ABSTRACT

An improved fence structure composed of aligned and interconnected fence sections, which are of two types, and which are arranged in staggered relation. In assembly, the fence sections of the first type, which have downwardly extending end posts, are received in male/female relation in recesses provided in a support surface along a fence line and, thereafter, the fence sections of the second type are connected to the installed fence sections of the first type.

1 Claim, 4 Drawing Figures

FENCE STRUCTURE

FIELD OF THE INVENTION

This invention relates to fences and, more particularly, to a fence composed of two types of interconnected fence sections arranged along a fence line which may be readily installed or removed.

BACKGROUND OF THE INVENTION

In the past, there have been numerous types of fence structures disclosed in the art. In certain types of installations it is desired to erect a temporary fence, that is, one which can be erected and removed relatively easily when there is no longer a need for it. This invention is of a fence which may be installed or removed readily. By way of examples, installations where such fences are desired are around swimming pools to guard against drowning of small children while visiting a home where there is a pool or, for crowd control during certain events. Generally, this invention is of an improved fence structure for such purposes.

It is, accordingly, a general of this invention to provide an improved fence structure of the type which can be installed readily and which is composed of two types of fence sections which are arranged in staggered relation with another and interconnected to form fence which can be readily removed when no longer required or desired.

It is another object of this invention to provide an improved fence composed of fence sections of a first and a second type each of which includes a pair of end posts with fastening means for connection to the adjacent fence post so that the fence sections are adapted to be arranged in staggered relation defining a fence.

Generally it is an object of this invention to provide a fence to be installed along a fixed prepared base which defines a fence line and which has pairs of recesses at spaced points therealong and into which the fence posts of one type of fence section are received so that between adjacent fence sections of that type, fence sections of a different type are adapted to be installed by connecting them to the fence sections of the first type which can be removed when desired, as will be more apparent from the following specification and read in conjunction with the accompanying drawings.

In accordance with these and other objects which will become apparent hereinafter, the instant invention will now be described with reference to the accompanying drawings in which:

DESCRIPTION OF PREFERRED EMBODIMENT

Figure 1:
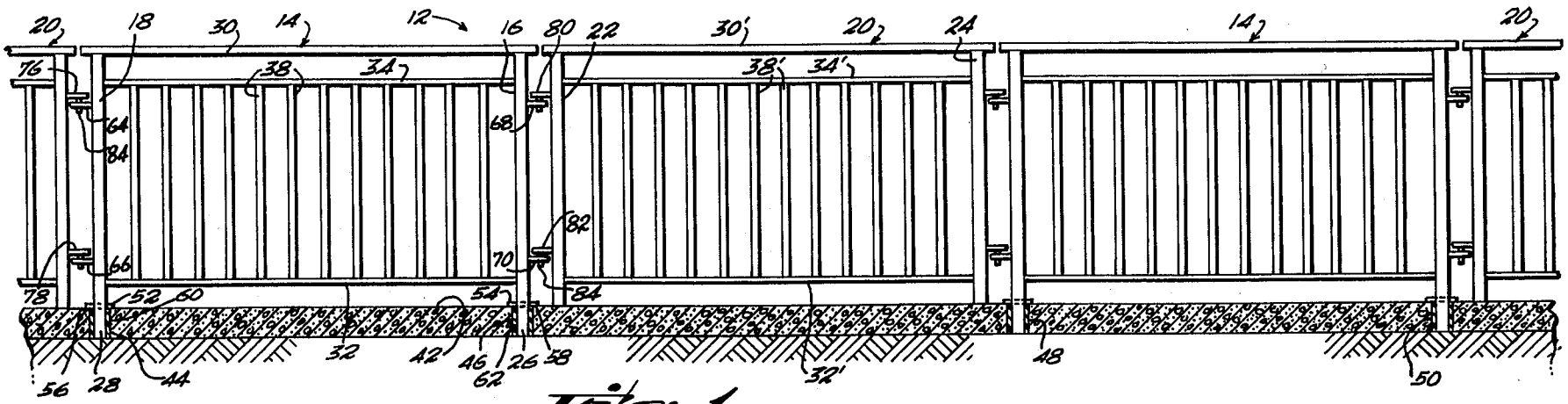
FIG. 1 is a side elevation view of a fence constructed in accordance with this invention.
Figure 3:
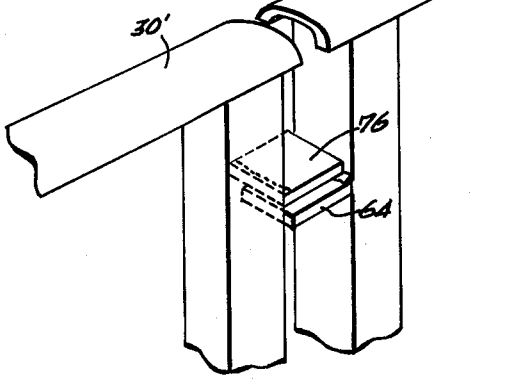
FIGS. 2 and 3 are partial perspective views illustrating the manner of assembly of adjacent fence sections.
Figure 4:
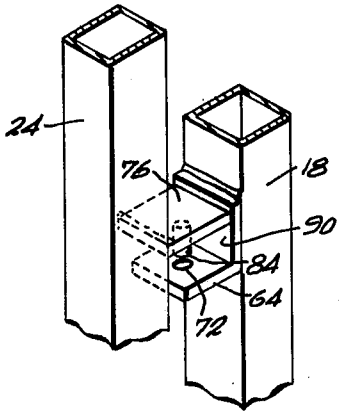
FIG. 4 is a partial perspective view similar to FIG. 2 of a preferred alternative embodiment in which the fastening means for assembly of adjacent fence sections includes positioning means.

Referring to the drawings wherein like reference characters designate like or corresponding parts throughout the several views the numeral 12 generally represents a fence constructed in accordance with this invention. It is composed of aligned fence sections which are of two types, of support type and a hanger type, and which are arranged in aligned staggered relation, i.e., every other fence section is of the same type. The first type 14 includes relatively long end posts 16 and 18 the end zones of which are received in prepared sockets along a fence line, while the second type 20 includes shorter end posts 22 and 24 rest on the main surface along the fence line.

In use, the first type fence sections are positioned in spaced relation along a fence line with their respective longer end zones 26 and 28 being received in recesses in a surface which are appropriately prepared. Thereafter, the second type of fence sections are aligned longitudinally with the first type sections and positioned between the first panels. Means to be described hereinafter are provided to interconnect the fence sections to form the fence. The structure of the two types of fence sections will now be described.

The first type fence section is bounded by a frame of a rigidly interconnected top rail 30, a bottom rail 32 and opposing end posts 16 and 18. In the illustration shown, each of the fence sections is decorative and has a central zone composed of an intermediate rail 34, adjacent the top rail but spaced downwardly therefrom a short distance. This intermediate rail spans the end posts and spaced vertical members, such as 38, connect it to the bottom rail 32.

The second type fence sections 20 are similarly constructed; and in the preferred embodiment corresponding parts thereof are designated by corresponding numerals to which a prime designation has been applied. The description of them will not be repeated for bevity.

The fence line support surface 42 is suitably prepared as follows. A footing of concrete is poured in a preferred embodiment. In the footing there are pairs of spaced recesses provided as at 44, 46 and 48, 50. The centerlines of the distance between the recesses of respective pairs are spaced fom one another an appropriate distance to matingly receive the end zones 26 and 28 of the first type fence section in male/female relation. The pairs of recesses are equispaced from one another to leave room for the second type fence section. In the preferred embodiment the depth of penetration of the end posts is determined by a flange, such as 52 and 54, fixed at a position and location on the end posts and which flanges are greater than the cross sectional area of the recess so that the flanges comprise bearing surfaces 56 and 58. Thus, the depth of the recesses need not be precise so long as each is of a sufficient depth. In the preferred embodiment a sleeve, such as 60 and 62 may be provided in each of the recess to jacket the end zone of the post in the particular recess. In the preferred embodiment illustrated in the drawings, the centerline between the end posts of each fence section are equispaced.

Figure 2:
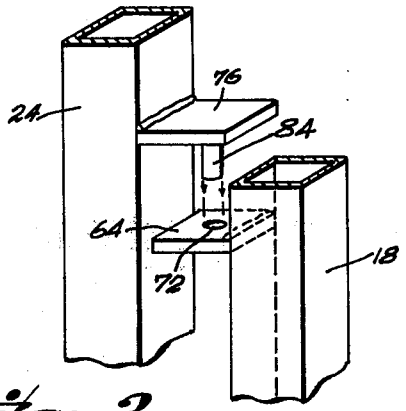

The fastening means for connecting the panels together are on the end posts of each of the sections. On each of the end posts of the first type fence section there is an upper and a lower longitudinally extending portion, such as a plate of a common length, 64 and 66, and 68 and 70. In each of these there is a hole, such as 72. On each of the fence sections of the other type, there is also a longitudinally extending portion which may also be a plate such as 76 and 78, and 80 and 82 and on each of these there is a downwardly extending pin such as 84, see FIG. 2. The longitudinally extending portions of the first type fence sections are at a predetermined height to mate with the corresponding portions of the portions of the fence sections of the second type.

In assembly, the fence panels of the first section are positioned in a line with their respective end zones in the recesses, thus defining a partial fence; and, thereafter, the fence sections of the second type are aligned with their respective pins being in holes of the adjacent end posts of the adjacent fence section. It will be apparent that, as a result of this construction and assembly, the fence may be disassembled by simply, first, removing the fence sections of the second or hanger type by lifting them upwardly until their respective pins clear the holes of the fastening means and removing them from the line; and, second, the fence sections of the first or support type may simply be lifted upwardly until the end zones of the end posts clear the recesses. Thereafter caps, not shown, may be positioned over the holes to cover them.

Thus, there is provided a removable fence which can be rapidly installed and removed as desired, such as around a pool.

Positioning or guide means may be included in the fastening means for ease in connecting the fence sections of the second type with those of the first type. This may be in the form of abutments. For example, on the fence post plates containing the holes, an upwardly projecting flange 90 may be provided so that, when the fence sections of one type are moved into alignment with the fence sections of the other type already installed, the two abutment surfaces will come into engagement, one with the other and, at that position, the pins and holes will be aligned with their centerlines in a common plane, so that the fence sections being installed are merely moved vertically into position against the guide surfaces of the positioning means.

What is claimed is:

1. A fence comprising a pluality of fence sections of two types, a first type and a second type, each type fence section including a pair of spaced end posts, the end posts of said second type being of a second length and the end posts of said first type being of a first length, said first length being longer than that of said second length and defining downwardly extending end post portions, said portions being adapted to be inserted into recesses in a support surface; and fastener means to interconnect the end post of the first type and the second type, said fastener means comprising mating surfaces extending longitudinally from each of the end posts and including mating pin and slot means;

said fastener means including positioning means to guide the fence section in the fastening operation of adjacent fence sections; and said positioning means comprising guide plates defining abutment surface on adjacent portions of the fastening means;

each of said fence sections includes an upper rail and a lower rail and said rails are spaced from one another defining a decorative panel and said fence including vertically extending, spaced slat members;

said fence being adapted to rest on a support surface having pairs of spaced recesses therealong defining a fence line and wherein the recesses of each pair are equispaced from one another a distance such that the respective vertical centerlines are spaced apart a distance equal to the distance between the end posts of said first type and said recesses are of an axial length depthwise in the support surface at least as long as the difference between said first and second length and the recesses being sized and configured and located on the fence line to receive an end post portion of said first type fence section;

means on said end post portions of the fence sections of said first type to limit penetration of said end post portions in said recesses;

said mating surfaces extending longitudinally from each of the end posts and comprising longitudinally extending surfaces arranged for sliding bypassing relation one over the other.

* * * * *